US007744162B2

(12) United States Patent
Griggs, Jr.

(10) Patent No.: US 7,744,162 B2
(45) Date of Patent: Jun. 29, 2010

(54) READY TO ASSEMBLE SOFA AND METHOD FOR PACKAGING SAME

(76) Inventor: Billy Joe Griggs, Jr., 3030 Minor Hill Hwy., Pulaski, TN (US) 38478

( * ) Notice: Subject to any disclaimer, the term of this patent is extended or adjusted under 35 U.S.C. 154(b) by 0 days.

(21) Appl. No.: 11/580,482

(22) Filed: Oct. 13, 2006

(65) Prior Publication Data

US 2008/0185897 A1 Aug. 7, 2008

Related U.S. Application Data

(60) Provisional application No. 60/726,304, filed on Oct. 13, 2005.

(51) Int. Cl.
*A47C 7/00* (2006.01)

(52) U.S. Cl. ..... 297/440.14; 297/440.15; 297/440.16

(58) Field of Classification Search ..... 297/440.1, 297/440.13, 440.14, 440.15, 440.16, 232
See application file for complete search history.

(56) References Cited

U.S. PATENT DOCUMENTS 2,660,228 A * 11/1953 Reinhold ..... 297/440.1
3,725,966 A * 4/1973 Blecker ..... 5/312
4,140,065 A * 2/1979 Chacon ..... 108/156
4,621,381 A * 11/1986 Schramek ..... 5/12.2
4,881,779 A * 11/1989 Bubien ..... 297/440.13
5,601,340 A * 2/1997 Stout ..... 297/440.16
5,683,137 A * 11/1997 McDonald et al. ..... 297/217.3
5,738,414 A * 4/1998 Wieland et al. ..... 297/440.1
5,740,564 A * 4/1998 Hankins et al. ..... 5/12.1
5,795,028 A * 8/1998 Dussia et al. ..... 297/440.14
6,241,317 B1 * 6/2001 Wu ..... 297/440.23
6,267,446 B1 * 7/2001 Wieland et al. ..... 297/440.13
6,367,880 B1 * 4/2002 Niederman et al. .... 297/440.14
6,839,950 B2 * 1/2005 Guillot ..... 29/428
6,942,298 B2 * 9/2005 Harrison ..... 297/440.1
7,044,557 B2 * 5/2006 Wieland ..... 297/440.1
7,188,908 B2 * 3/2007 White et al. ..... 297/440.14
7,252,339 B2 * 8/2007 Owens ..... 297/440.1
2002/0093235 A1 * 7/2002 Niederman et al. ..... 297/440.1
2003/0146653 A1 * 8/2003 Butler ..... 297/440.1
2003/0193230 A1 * 10/2003 Guillot ..... 297/440.1
2005/0006943 A1 * 1/2005 Wieland ..... 297/440.13
2005/0067876 A1 * 3/2005 Dortch ..... 297/440.1
2005/0179303 A1 * 8/2005 Owens et al. ..... 297/440.1
2005/0225153 A1 * 10/2005 Ou ..... 297/440.1

* cited by examiner

*Primary Examiner*—Sarah B McPartlin
(74) *Attorney, Agent, or Firm*—David W. Barman; Robert M. Schwartz

(57) ABSTRACT

A furniture system having a base frame, side pieces and a back portion, that assembles quickly and disassembles into a configuration that optimizes space when shipped.

6 Claims, 8 Drawing Sheets

A

B

C

A

B

READY TO ASSEMBLE SOFA AND METHOD FOR PACKAGING SAME

INDEX TO RELATED APPLICATIONS

This application claims benefit of provisional application Ser. No. 60/726,304 filed Oct. 13, 2005 the disclosure of which is incorporated herein by reference in its entirety.

BACKGROUND OF THE INVENTION

The present invention relates generally to ready-to-assemble ("RTA") furniture. More specifically, the present invention relates to RTA sofas, RTA love seats, RTA chairs and similar articles of RTA furniture that are configured for rapid assembly from a partially assembled state to a fully assembled state after shipping and storage stages.

BRIEF SUMMARY OF THE INVENTION

This present invention, an article of RTA furniture, includes a base assembly, a back assembly and left and right arm assemblies that are constructed and arranged for minimizing packaging volume in a partially assembled state and for rapid assembly from said partially assembled state to a fully assembled state with minimal effort and tools.

In one embodiment, the invention comprises an upholstered furniture system comprising:

a first assembled configuration for seating;

a second unassembled configuration for storage and shipping, comprising:

a horizontal seat support frame having front and rear support frame members; wherein said rear support member comprises at least two male fasteners for receiving complementary female fasteners from a seat back frame;

left and right side support frame members, wherein said left and right side support frame members each comprise at least 2 orifices for receiving two male fasteners for interacting with complementary female fasteners from a respective arm member;

a back member, having male fasteners for assembling with complementary female fasteners secured to said horizontal seat support frame;

left and right arm members, each of said left and right arm members having a female fastener for receiving male fasteners attached to said horizontal seat support frame; and wherein said horizontal seat support frame comprises a cavity to contain, in said unassembled configuration, each of said arm members to be used with said furniture system.

The cavity may, in one embodiment, further contain cushions used in said assembled configuration.

In the furniture system of the present invention, said unassembled configuration is substantially rectangular. Previous to construct a furniture system as per the present invention were unsuccessful because those attempts did not account for storage of arm portions. The present invention provides that in said unassembled state, arm portions nest within a cavity formed within the border of said horizontal seat support frame.

Said arm portions may interconnect in a dissembled state such that they nest within the boundary of said cavity in said horizontal seat support frame.

Said back member is constructed and arranged to connect to said horizontal seat support frame by a male-female connection.

In the furniture system each of said left and right arm members attach to said horizontal seat support frame by interacting with male connection of placed through said frame with orifices on each of said left and right arm members and said left and right arm members are secured with hand tightening nuts, such as wing nuts. This assembly system provides a process that allows assembly without the use of tools.

Also contemplated is a method of shipping Ready to Assemble (RTA) furniture, comprising the steps of:

(a) providing RTA components of furniture comprising:

a horizontal seat support frame;

left and right side pieces;

a back frame;

cushions;

(b) assembling said RTA components such that they form a rectangular configuration, wherein said rectangular configuration provides said left and right side portions constructed and arranged to nest within the underside of said horizontal seat support frame, and said back portion nests on top of said frame; and packaging said RTA furniture into a conventional shipping container such that each unit forming said rectangular frame efficiently utilizes the available shipping space within a conventional shipping container.

In another embodiment the present invention is an upholstered furniture system consisting of:

a first assembled configuration for seating;

a second unassembled configuration for storage and shipping, comprising:

a horizontal seat support seat support frame having front and rear support frame members; wherein said rear support member comprises at least two male fasteners for receiving complementary female fasteners from a seat back frame;

left and right side support frame members, wherein left and right side support frame members each comprise a pair of male fasteners for receiving complementary female fasteners from a respective arm member;

a back member, having male fasteners for assembling with complementary female fasteners secured to said horizontal seat support frame;

left and right arm members, each of said left and right arm members having an female fastener for receiving male fasteners attached to said horizontal seat support frame; and wherein said horizontal seat support frame comprises a cavity to contain each of said arm members and cushions to be used with said furniture system.

The cavity may, in one embodiment, further contain cushions used in said assembled configuration. In the furniture system of the present invention, said unassembled configuration is substantially rectangular. Previous attempts at providing RTA furniture and systems to maximize shipping space did not account for storage of arm portions.

The present invention provides that in said unassembled state, arm portions nest within a cavity formed within the border of said horizontal seat support frame.

Said arm portions may interconnect in a dissembled state such that they nest within the boundary of said cavity in said horizontal seat support frame.

Said back member is constructed and arranged to connect to said horizontal seat support frame by a male-female connection.

In the furniture system each of said left and right arm members attach to said horizontal seat support frame by interacting with a male connection placed through said frame with orifices on each of said left and right arm members and said left and right arm members are secured with wing nuts, or hand tightening nuts. Thus assembly is without the use of tools.

The base assembly includes a base frame having a storage cavity for receiving the left and right arm assemblies for storage during shipment and storage of the article of furniture. Use of movable supports transversing the storage cavity facilitates storage of the arm assemblies when the supports are moved out of the way and provides needed strength and rigidity when the supports are moved into a support position during final assembly of the article of RTA furniture. This novel feature of storing the arms in the base cavity allows for a significant reduction of shipping volume per unit of furniture, which in turn greatly reduces shipping and handling costs. Conventionally, the RTA arms would be shipped in a shipping box separate from the box housing the base and back assemblies. In addition to the saving in reduction of volume, handling costs and inventory losses are reduced because shipping is consolidated to a single shipping box.

In one preferred embodiment, the base frame is a box frame having a base front frame portion, a base rear frame portion, and right frame portion and left frame portion. Upon final assembly, one or more movable support members transverse the storage cavity to provide structural support of the base assembly during use of the article of furniture. In one preferred embodiment, the moveable support members comprise swing gates. The base frame also includes right and left base extensions for receiving the left and right arm assemblies for rapid assembly of the RTA article of furniture. The frame extensions each include a lower arm mounting assembly upon which an upper arm mounting assembly of the respective arm assembly is received. Fast operating fastener components premounted upon the upper and lower arm mounting assemblies allow for rapid attachment of the arm to the base frame extension. In one preferred embodiment, wing-nut fastener assemblies are used. In another preferred embodiment snap-in fasteners are used.

The base assembly also includes base cushions and a cushion support, such as interwoven webbing or box springs. The base assembly further includes upholstery covering portions of the base frame. One advantage of this assembly is that the right and left base extensions are not upholstered while the front, the outside, the top and the inside portions of the arm assemblies are fully upholstered. This provides a small vertical crevasse between the upholstered arm and the upholstered front of the base assembly. This is characteristic of conventionally manufactured furniture. The arm fronts of prior art RTA furniture have only the upper portion upholstered while the front face of the base assembly is fully upholstered. This creates an elongated horizontal crevasse along the front of each arm.

The base assembly further has a quick connecting bracket either receiving or being received by the opposite gendered bracket of the back assembly. The base cushions and the back cushions (if detachable) are vacuum packed and stacked between the base assembly (with the arms placed in the storage cavity) and the back assembly in a minimal volume configuration. The RTA article is optionally compressed further and placed in a storage container such as a shipping box.

It is another object of the present invention to provide a ready to assemble furniture system that assembles without the use of tools.

DETAILED DESCRIPTION OF THE INVENTION

Figure 1:
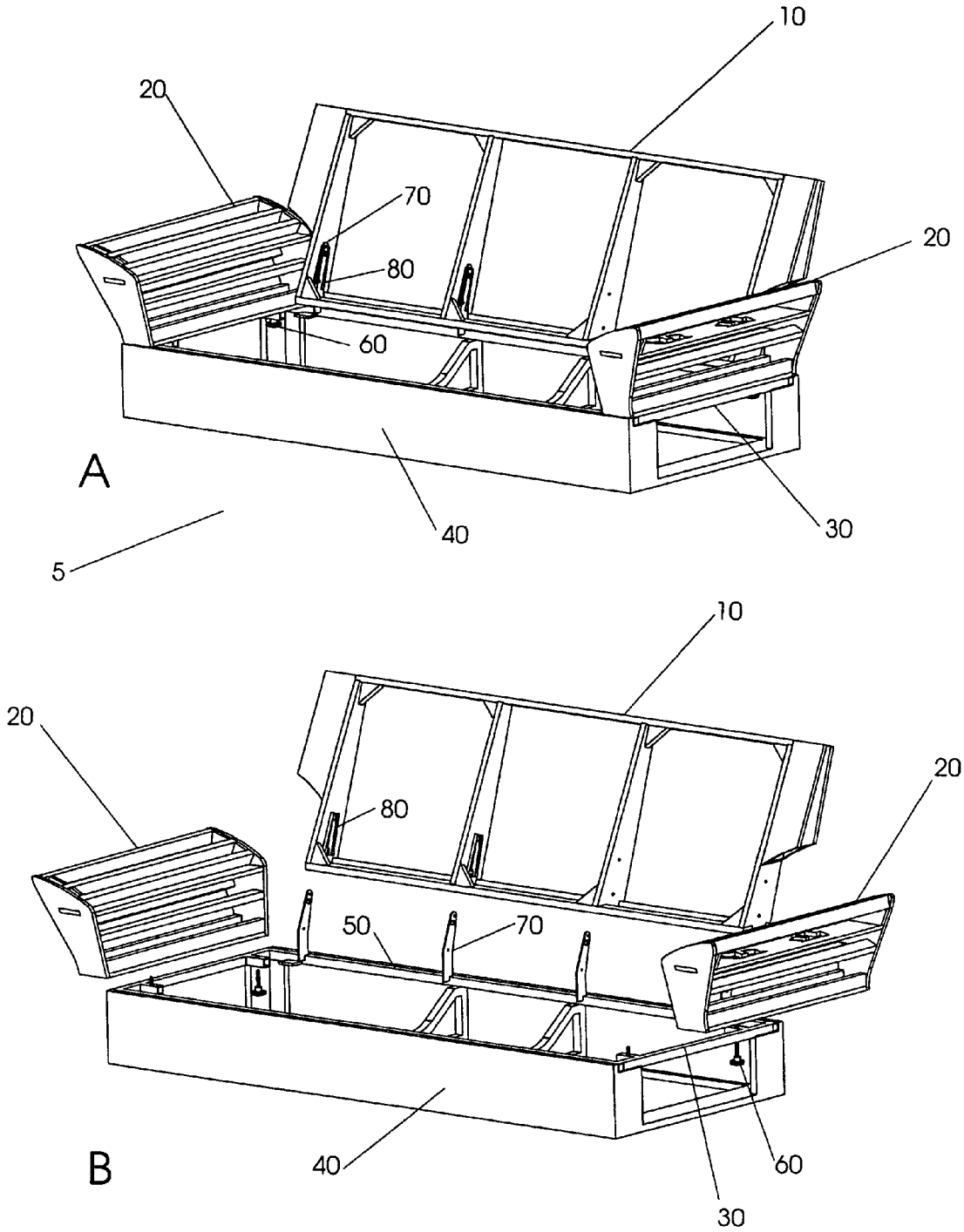
FIG. 1 shows a perspective view of the assembled (A) and unassembled (B) configurations.

Referring now to FIG. 1A, is one embodiment of the fully assembled RTA frame 5 and is shown including the base assembly frame 40 and the left and right arm frames 20 connected to each side portion 30 with a screw 60, and the back frame 10 joined to rear portion of frame 50 by male connector 70 and female connector 80 in an assembled configuration. This RTA frame is typically obscured by padding and upholstery when the RTA furniture is manufactured. FIG. 1B shows a perspective view with each of the aforementioned elements separated from their attached configuration.

Figure 2:
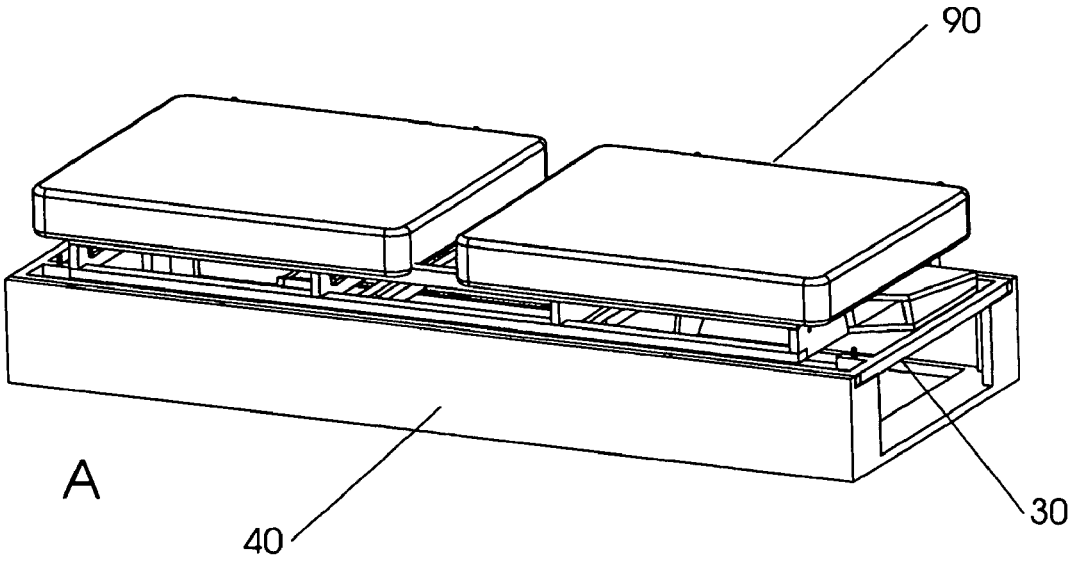
FIG. 2 shows perspective (A) and side views (B) of one embodiment of the sofa packaged for shipping.
Figure 2:
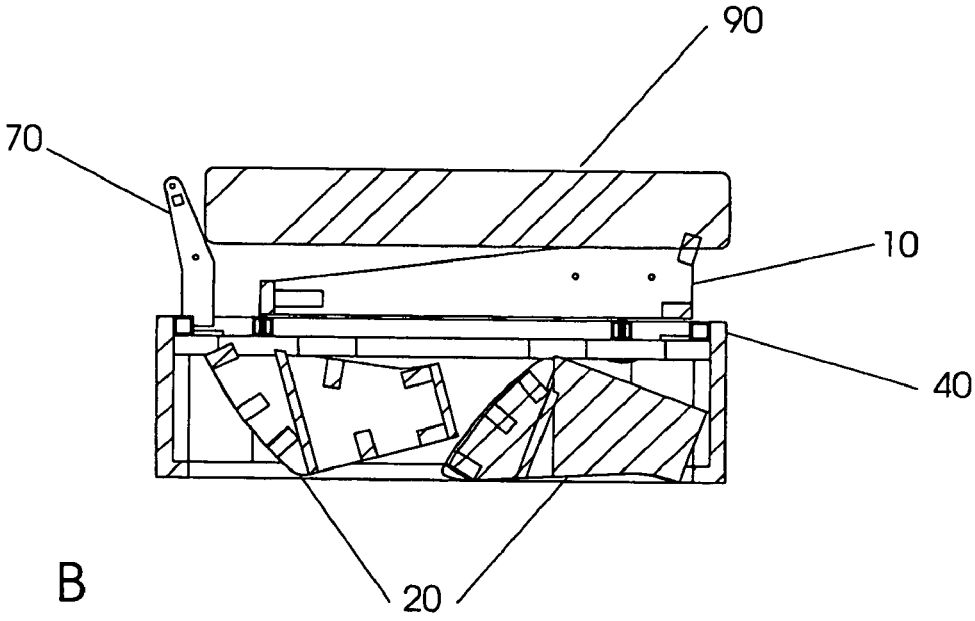

Referring now to FIG. 2A shows a perspective view of the unassembled system. The front of the frame 40 side portion of frame 30, and, in the shown embodiment, cushions 90 are shown placed on top of frame 40 for storage to substantially form a rectangular configuration. Said rectangular configuration is defined as a horizontal planes corresponding to each side of said horizontal seat support frame. That is to say, component pieces do not extend outward past the sidepieces of the horizontal seat support frame. The component pieces also do not extend outward past each of the front and back potions of the horizontal seat support frame. Previous attempts at RTA furniture for storage were deficient in that the arm portions extended outward from the frame when stored. The extensions of the arm portions from the rectangular configuration in which the configuration is defined by the shape of the base alone has made shipping such systems less efficient than those systems manufactured according to the current invention. Also shown is FIG. 2B, a side view whereby arm portions 20 are placed in a nesting arrangement in a cavity inside frame 40. Back portion 10 is placed on top of frame 40 and cushions 90 are on top of back portion 10.

Figure 3:
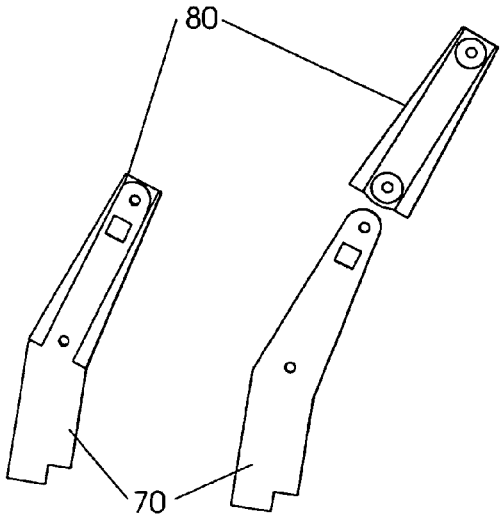
FIG. 3 shows close up views of the male-female connectors (A) for the back frame and the connected arrangement (B) and the disconnected arrangement (C) for the back frame portion of the sofa to the frame.
Figure 3:
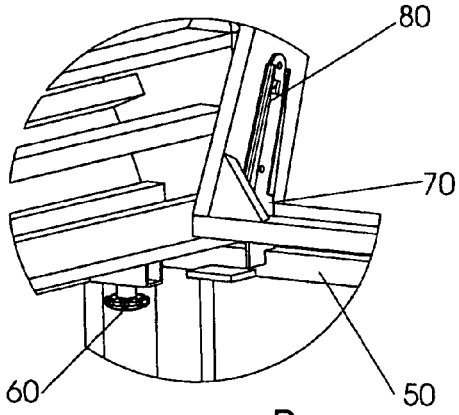
Figure 3:
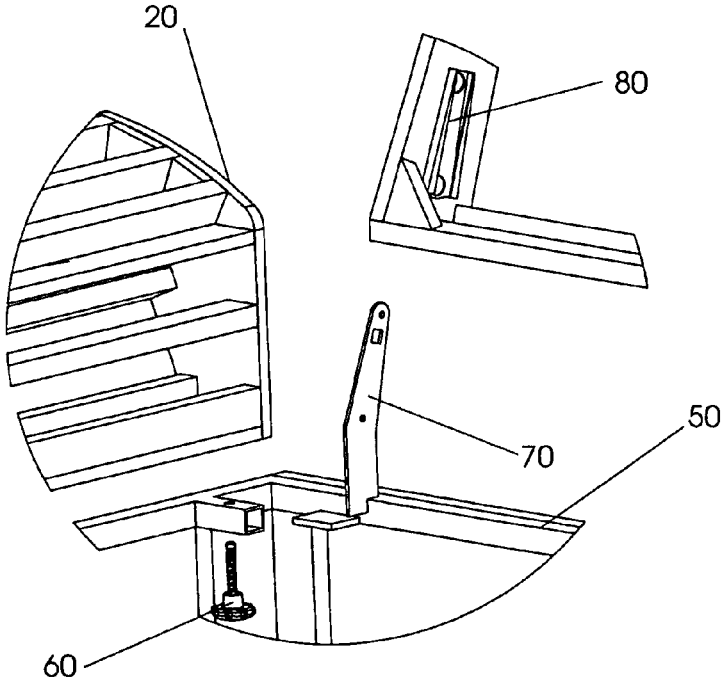

Referring now to FIG. 3A a detail of the embodiment, as is shown in male connector 70, which was shown in FIG. 1 attached to the rear portion of the frame interacts with female connector 80, which was shown in FIG. 1 connected to back frame portion 10. The interaction of the male-female 70 and 80 connection allows the back portion to be secured to the frame. In a preferred embodiment, no tools are required to effectuate the interaction and connection. FIG. 3B shows a view of the male connector 70 and female connector 80 attaching along transverse portion of support frame 50 in their interconnected state and FIG. 3C shows male connector 70 and female connector 80 attaching along transverse portion of support frame 50 in their disconnected positions.

Figure 4:
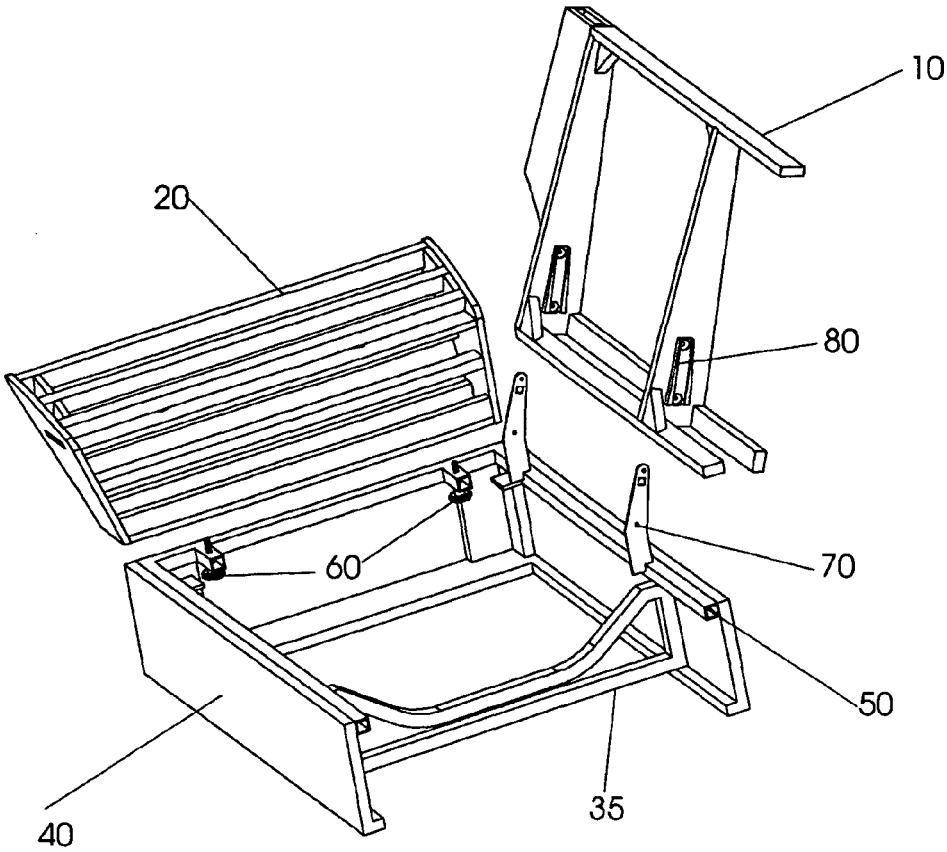
FIG. 4 shows close up views (A) and (B) depicting the attachment of the back and side portions to the frame.
Figure 4:
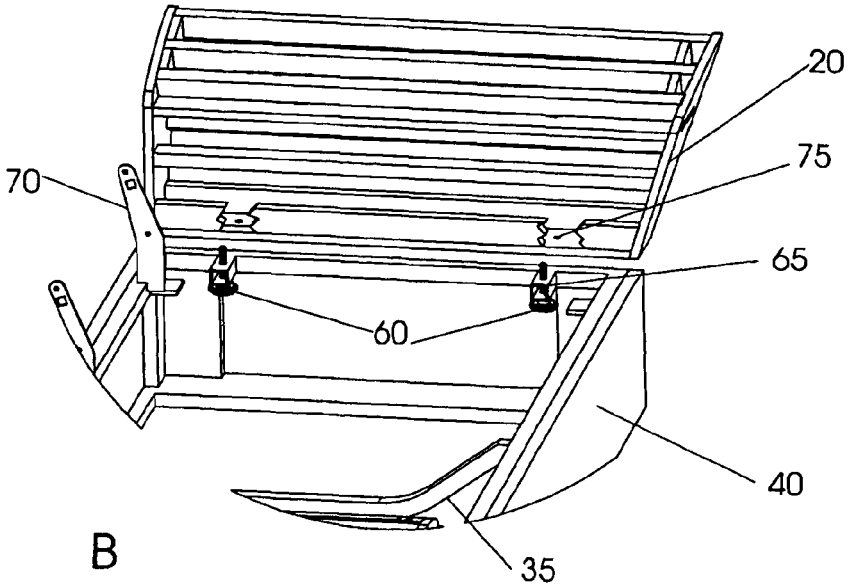

Referring now to FIG. 4A, is a cut away view of the upper drawing shows side 20 that will receive mounting screw 60 through an incorporated orifice. The lower drawing shows a close up view of the attachment of side 20. In a preferred embodiment, a T-nut (shown in FIG. 6 close-up) is permentantly attached to sidepiece 20 and the inner portion of T-nut creates a complementary threaded orifice to receive the threads from screw 60. In this embodiment, screws 60 have heads suitable for tightening by hand. Also shown in FIG. 4A is support brace 35 which is on the interior of frame 40 and helps to support and stabilize the full assembled system. FIG. 4B further show receiver 65 whereby the shaft of screw 60 is inserted into a central orifice in receiver 65 and the shaft interconnects with T-nuts located within channel 75 incorporated into sidepiece 20.

Figure 5:
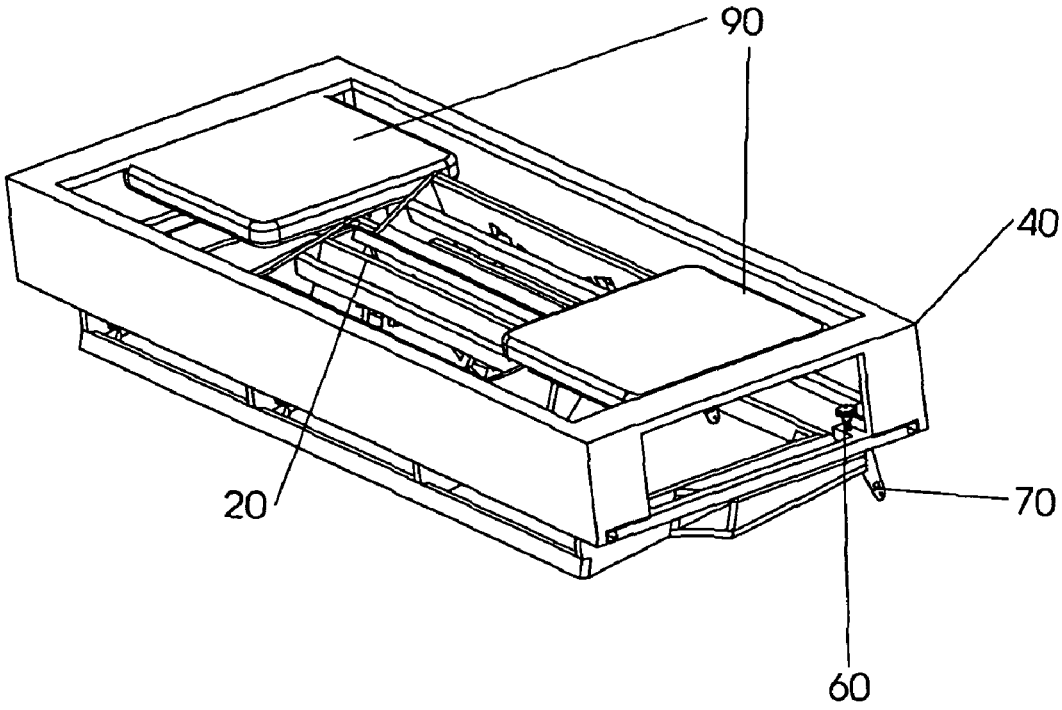
FIG. 5 shows an alternative embodiment whereby side pieces and cushions nest within a cavity on the underside of the frame for shipping. The cushions are vacuum packaged to reduce volume of space needed for storage and shipping.

In an alternative embodiment of this invention shown in FIG. 5, the entire article of RTA furniture is in a stacked configuration, with the interlocked arms 20 and cushions 90 stored in the storage cavity. Cushions 90 may be placed in a vacuum sealed bag to reduce the volume required and make them smaller to ship because typically, cushions are foam or feather and contain a significant volume of space occupied by air. Removing the air reduces the volume required to store and ship cushions 90. In this alternate embodiment, the back assembly, the back and seat cushions and the arm assemblies may be vacuum packaged separately or in combination.

Figure 6:
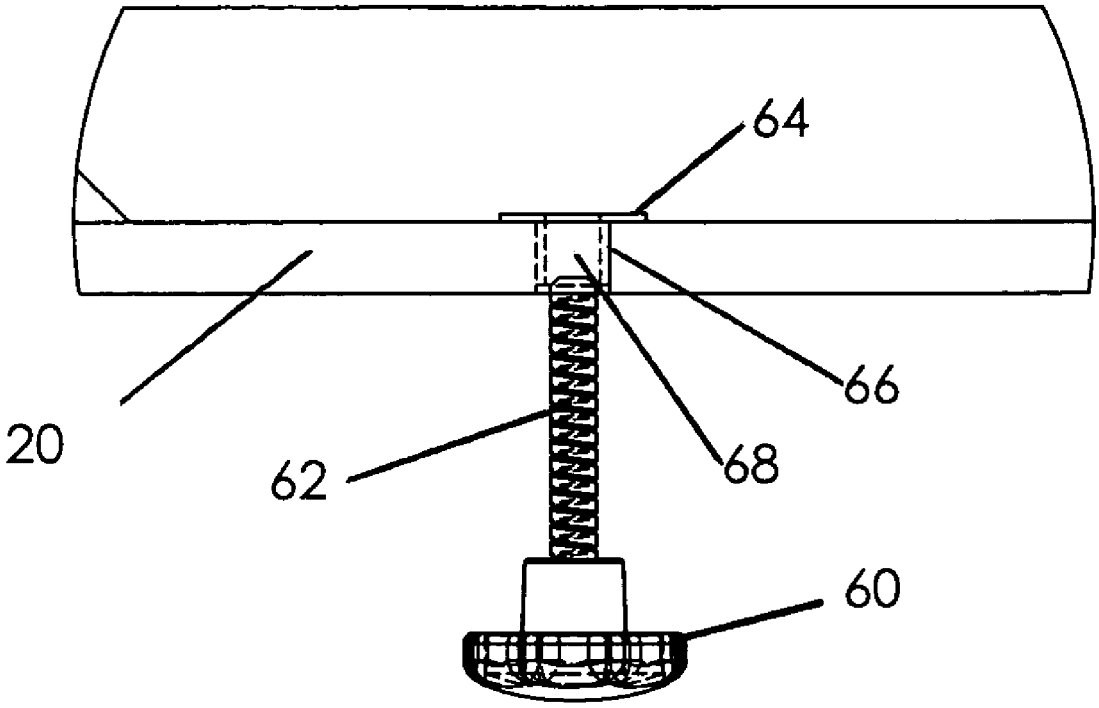
FIG. 6 is a close up partial cross section showing connection of a screw attaching into a t-nut set into a sidepiece.

Referring to FIG. 6, a T-nut 64 is mounted onto sidepiece 20 in channel 75 (previously shown). The t-nut 64 has inner circumferal threaded portion 66 that forms a circular channel 68. The inner circumferal threaded portion 66 interacts with the screw threaded shaft 62 of screw 60 and serves to secure sidepiece 20 onto the aforementioned frame.

Support brace 35 is a swivel swing gate that supports frame 50 in a vertical orientation and pivots on swivel pins 38 to a horizontal orientation resulting in an unobstructed cavity within the sofa frame. There is a swivel pin 38 on each longitudinal opposite end of the swing gate although only a single swivel pin 38 is shown in the figure.

Figure 7:
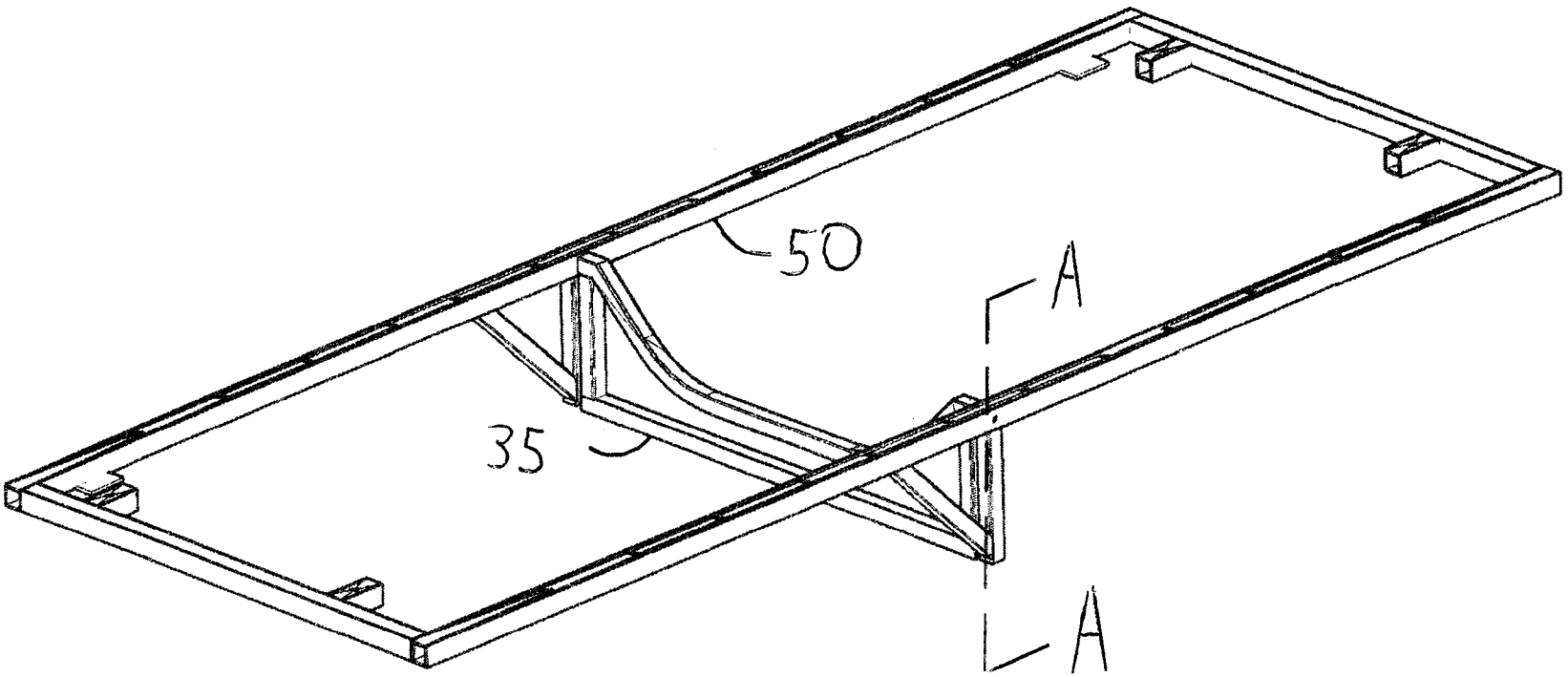
FIG. 7 is a perspective view of the support frame with a swivel swing gate in a vertical position relative to the frame.
Figure 8:
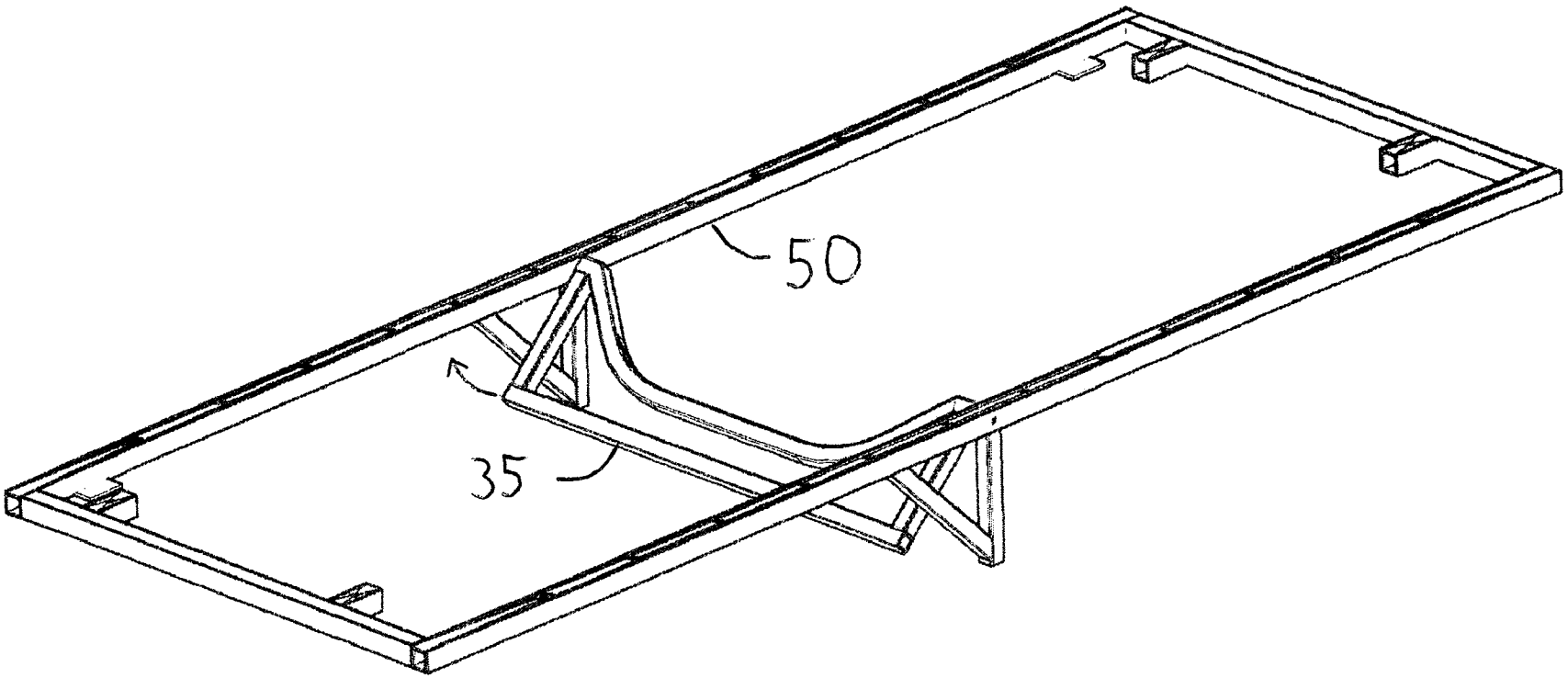
FIG. 8 is a perspective view of the support frame with a swivel swing gate moved along directional arrow from a vertical position relative to the frame.

FIGS. 7-8 show progressive steps of swivel swing gate moving from vertical to horizontal orientation.

In assembling a preferred embodiment, the article of the present invention, the components are separated and the frame is placed in an upright position, e.g. positioned upright so as to receive the component parts and be usable upon assembly. Back portion 10 is connected to the back frame 50 using the male-female connectors described. Then each sidepiece is connected to the frame through use of hand screws interacting with T-nuts permanently mounted into incorporated orifices into each of said side pieces. An appropriate support may then be attached to the frame to hold desired seat portions and/or cushions. The assembled system may now receive any appropriate upholstery covering for the side and back portions. As previously mentioned, the assembly of the present invention may be assembled without the use of tools. Many RTA products require numerous component parts, tools, and take a significant amount of time and effort to assemble. The RTA system of the present invention provides not only a cost savings in shipping, but also a savings in labor for assembling. One the article is unpacked from shipping configuration; it comprises 4 major components and assembles quickly. Attach the back with the aforementioned male-female connectors, attach each of the sidepieces and secure with hand screws, and the RTA assembly is completed. Additionally, the manufacturing costs are reduced because the majority of the system is assembled from 4 major components.

Assembly of the system of the present invention on a commercial scale is also economized because any assembly line processes can be done quickly and without the use of tools.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. An upholstered furniture system comprising:

(a) a first assembled configuration for seating;

(b) a second unassembled configuration for storage and shipping, said upholstered furniture system comprising:

(i) a horizontal seat support frame, said frame having opposing front and rear panels and opposing side panels, said panels arranged fixedly and continuously to define a rectangular storage cavity, said frame further comprising one or more movable support members extending generally perpendicularly between said front and rear panels and within said cavity, said movable support members being swivel swing gates, wherein each swing gate has opposing vertical sides that are parallel and adjacent to an inner surface of each of said front and rear panels and each swing gate further includes a bottom member extending between each of said vertical sides, said swivel swing gates are positioned within said cavity and extend in a perpendicular orientation between each of said front and rear panels, allowing said gate to swivel on said swivel pin, said swing gate is configured to pivot into vertical and horizontal orientations relative to said frame;

(ii) a back frame member, having a plurality of male fasteners;

(iii) left and right arm members, each of said left and right arm members having female fasteners;

(iv) wherein said rear support panel comprises at least two male fasteners for receiving said female fasteners from said seat back frame;

(v). wherein said left and right side support frame panels each comprise a pair of male fasteners for receiving said female fasteners from a respective arm member; and wherein in said second unassembled configuration said swing gate pivots into said horizontal orientation relative to said frame, and said arm members and a plurality of cushions to be used in said system are positioned in said cavity.

2. The furniture system of claim 1, wherein said unassembled configuration is substantially rectangular.

3. The furniture system of claim 2, wherein said rectangular configuration is defined by horizontal planes corresponding to each side of said horizontal seat support frame.

4. The furniture system of claim 1 wherein said arm portions interconnect in a dissembled state such that said arm portions nest within the boundary of said cavity in said horizontal seat support frame.

5. A method of shipping Ready to Assemble (RTA) furniture comprising the steps of:

(a) providing RTA components of furniture comprising:

i) a horizontal seat support frame, said frame having opposing front and rear panels and opposing left and right side panels, said panels arranged fixedly and continuously to define a rectangular storage cavity, said frame further comprising one or more movable support members extending generally perpendicularly between said front and rear panels and within said cavity, said movable support members being swivel swing gates wherein each swing gate has opposing vertical sides that are parallel and adjacent to an inner surface of each of said front and rear panels and each swing gate has bottom member extending between each of said vertical sides, said swivel swing gates are positioned within said cavity and extend generally in a perpendicular orientation between each of said front and rear panels, and said swing gate is configured to pivot into vertical and horizontal orientations relative to said frame;

(ii) a back frame member, having a plurality of male fasteners;

(iii) left and right arm members, each of said left and right arm members having female fasteners; wherein said rear support panel comprises at least two male fasteners for receiving said female fasteners from said seat back frame and further wherein said left and right side support frame panels each comprise a pair of male fasteners for receiving said female fasteners from a respective arm member;

(iv) cushions;

(b) assembling said RTA components such that they form a rectangular configuration, wherein said rectangular configuration provides said left and right arm members; nest within the rectangular storage cavity of said horizontal seat support frame when said movable support members are moved in a swivel motion about a said pin, to a horizontal orientation relative to said frame, to facilitate storage of said RTA components in said horizontal seat support frame, and said back portion nests on top of said frame;

(c) packaging the rectangular configuration of the RTA components into a conventional shipping container and substantially maximizing utilization of available shipping space within said conventional shipping container.

6. The method of claim 5 wherein said cushions are vacuum packaged to reduce volume of space needed for storage and shipping.

* * * * *